US007117879B1

(12) United States Patent
Massey

(10) Patent No.: US 7,117,879 B1
(45) Date of Patent: Oct. 10, 2006

(54) RAIN COVER FOR HAY ENCLOSURES

(76) Inventor: Timothy E. Massey, 2400 Blackjack Rd., Trussville, AL (US) 35173

( * ) Notice: Subject to any disclaimer, the term of this patent is extended or adjusted under 35 U.S.C. 154(b) by 246 days.

(21) Appl. No.: 10/909,697

(22) Filed: Aug. 2, 2004

(51) Int. Cl.
*E04H 15/36* (2006.01)
*E04H 15/48* (2006.01)

(52) U.S. Cl. ..... 135/132; 135/88.01; 206/83.5; 296/109; 296/100.18

(58) Field of Classification Search ..... 135/132, 135/133, 906, 88.01; 206/83.5; 296/100.11, 296/100.12, 100.13, 100.14, 100.15, 100.17, 296/100.18, 109; 52/3, 66, DIG. 12; 150/154
See application file for complete search history.

(56) References Cited

U.S. PATENT DOCUMENTS

| | | | | | |
|---|---|---|---|---|---|
| 202,748 | A * | 4/1878 | Overfield | 52/32 |
| 964,333 | A * | 7/1910 | Takacs | 135/134 |
| 2,877,722 | A * | 3/1959 | Peat | 105/377.02 |
| 4,248,343 | A | 2/1981 | Schaefer | 206/83.5 |
| 4,402,544 | A * | 9/1983 | Artim et al. | 296/110 |
| 4,488,565 | A | 12/1984 | Smith | 135/100 |
| 4,521,997 | A | 6/1985 | Tiberend | 52/3 |
| 4,716,919 | A * | 1/1988 | Griffin | 135/133 |
| 4,825,484 | A * | 5/1989 | Riegel | 5/97 |
| 5,671,551 | A | 9/1997 | Adam | 34/201 |
| 2006/0054208 | A1 * | 3/2006 | Romano | 135/132 |

* cited by examiner

*Primary Examiner*—Robert Canfield
(74) *Attorney, Agent, or Firm*—Sturm & Fix LLP

(57) ABSTRACT

A rain cover (10) to protect bales of hay (200) within a hay enclosure framework (100) having horizontal top (101) and bottom (102) framework segments connected to one another by vertical support struts (103) wherein, the rain cover (10) includes an elongated waterproof cover member (40) having spaced sleeve elements (42) (42) that captively engage the intermediate portion of a plurality of elongated generally C-shaped support arm members (30) (30) the opposite ends of which are captively and slidably associated with a pair of U-bolt members (20) mounted on the top framework segment (101) of the hay enclosure framework (100).

6 Claims, 2 Drawing Sheets

RAIN COVER FOR HAY ENCLOSURES

CROSS REFERENCE TO RELATED APPLICATIONS

This invention was the subject matter of Document Disclosure Program Registration Number 550,994, filed in the U.S. Patent and Trademark Office on Apr. 9, 2004.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of cover arrangements for hay bales in general and in particular to a retractable rain cover for hay enclosures.

2. Description of Related Art

As can be seen by reference to the following U.S. Pat. Nos. 5,671,551; 4,488,565; 4,521,997; and, 4,248,343, the prior art is replete with myriad and diverse cover arrangements for hay bales.

While all of the aforementioned prior art constructions are more than adequate for the basic purpose and function for which they have been specifically designed, they are uniformly deficient with respect to their failure to provide a simple, efficient, and practical rain cover for hay enclosure frameworks having top and bottom horizontal framework segments connected to one another by a plurality of vertically oriented support struts.

As anyone who has livestock such as horses and cattle is all too well aware, once a hay bale has been soaked by rain, the animals will stop feeding on the hay until it has been replaced by a fresh quantity of dry hay that has not been exposed to moisture.

As a consequence of the foregoing situation, there has existed a longstanding need among owners of livestock for a new and improved rain cover for hay enclosures that is simple to install and only requires a single person to retract the cover from the hay enclosure; and the provision of such a construction is a stated objective of the present invention.

BRIEF SUMMARY OF THE INVENTION

Briefly stated, the rain cover that forms the basis of the present invention comprises in general a cover unit, a support unit, and a mounting unit which is adapted to engage the top horizontal segment of a hay enclosure framework.

As will be explained in greater detail further on in the specification, the mounting unit includes a pair of U-bolt members that are disposed on the opposed sides of a hay enclosure framework to secure the support unit and its attached cover unit to the upper horizontal framework segments of the hay enclosure.

In addition, the support unit comprises a plurality of elongated C-shaped support arm members the opposite ends of which are pivotally and slidably associated with the U-bolt members wherein, the intermediate portions of each of the support arm members are operatively connected to the cover unit.

The cover unit comprises an enlarged flexible fabric cover member provided with a plurality of interior sleeve elements wherein, each of the sleeve elements is dimensioned to threadedly receive the intermediate portion of one of the support arm members such that the cover member may be lifted from either side of the top of the hay enclosure framework and folded over onto the opposed side of the enclosure framework to refill the enclosure framework with hay.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
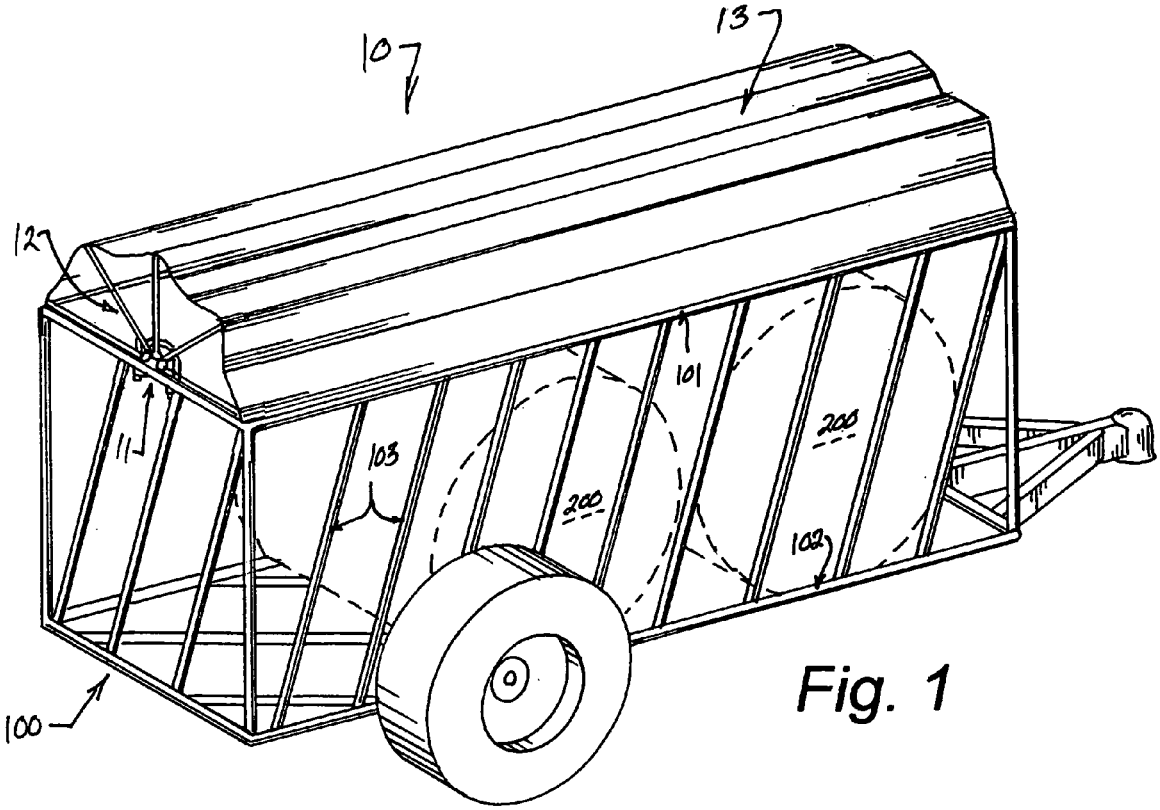
FIG. 1 is a perspective view of a wheeled enclosure framework provided with the rain cover that forms the basis of this invention.

As can be seen by reference to the drawings, and in particularly to FIG. 1, the rain cover for the hay enclosure framework that forms the basis of the present invention is designated generally by the reference number 10. The rain cover 10 comprises in general a mounting unit 11, a support unit 12, and a cover unit 13. These units will now be described in seriatim fashion.

Prior to embarking on a detailed description of the rain cover 10, it would first be advisable to describe the specific environment in which this invention is intended to be employed.

Figure 2:
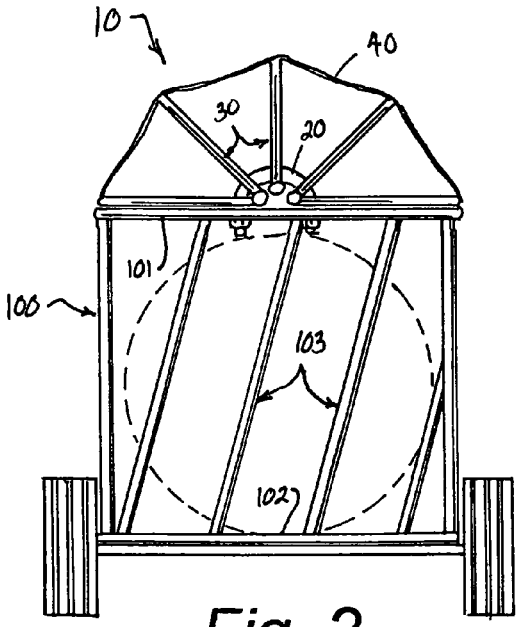
FIG. 2 is an end view of the arrangement depicted in FIG. 1.

As shown in FIGS. 1 and 2, the rain cover 10 is specifically designed for use on a hay enclosure framework designated generally as 100 and including horizontal top and bottom 102 framework segments joined to one another by a plurality of generally vertical support struts 103 to define an open top hay enclosure framework 100 dimensioned to receive one or more round bales of hay 200.

Figure 4:
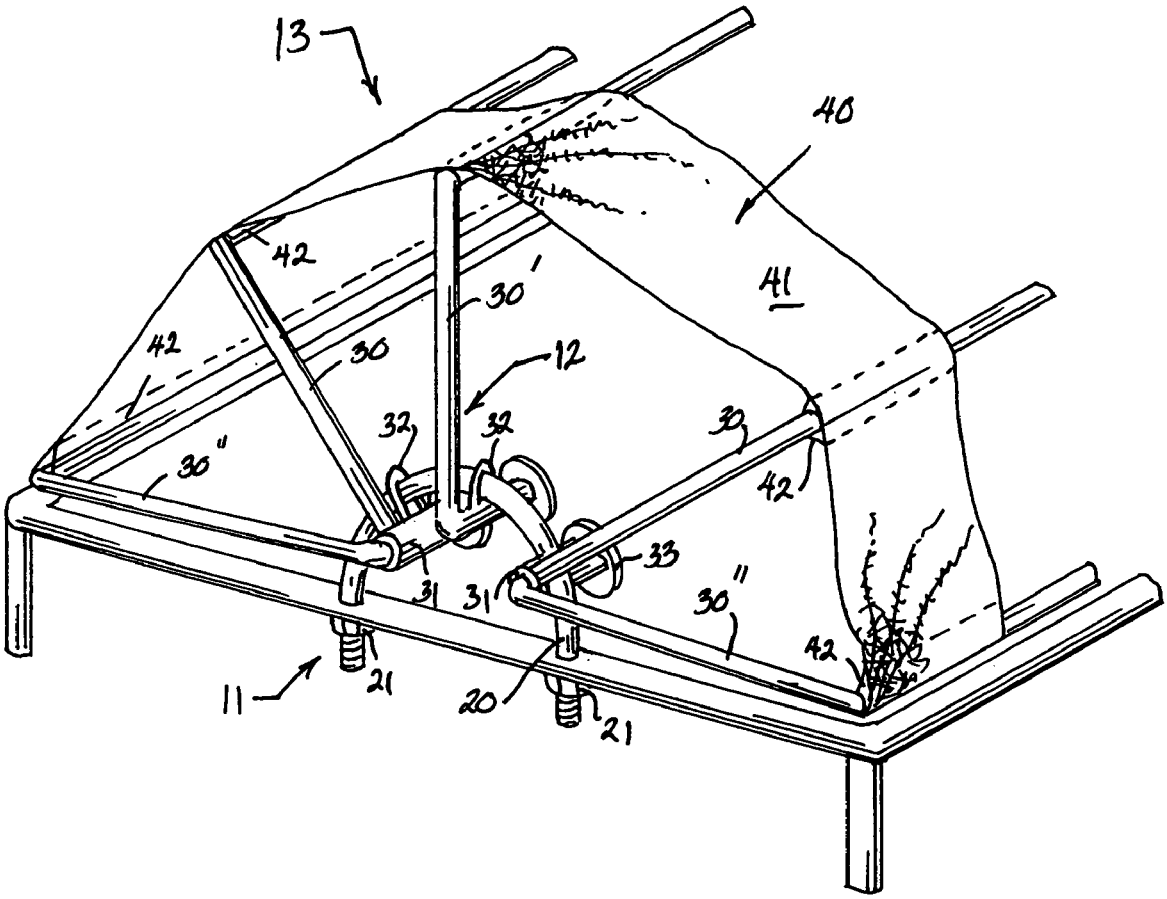

As can best be seen by reference to FIG. 4, the mounting unit 11 comprises a pair of U-bolt members 20 each disposed on, and operatively secured to, one of the opposite ends of the top framework segments 101 of the hay enclosure framework via a pair of conventional fasteners 21 21.

In addition, as can also be seen by reference to FIG. 4, the support unit 12 comprises a plurality of elongated generally C-shaped support arm members 30 the opposite ends of which are pivotally and/or slidably associated with each of the U-bolt members 20 as will be described presently.

In the preferred embodiment of the invention depicted in FIG. 4, at least some of the support arm members 30 are directly connected to the U-bolt members 20 via a hollow collar element 31 provided with a connector loop 32 at least one of the support arm members 30' is directly connected to the U-bolt member via a connector loop 32 and still others of the support arm members 30" are dimensioned to be rotatably yet captively connected to the hollow collar elements 31 31 via a flanged end 33.

Regardless of their particular mode of connection, it is imperative according to the teachings of this invention for the opposed ends of the support arm members 30 30' 30" to freely slide along the arc defined by each of the U-bolt members.

Still referring to FIG. 4, it can be seen that the cover unit 13 comprises an elongated cover member 40 fabricated from flexible waterproof material 41 wherein, the interior surface of the cover member 40 is provided with a plurality of spaced elongated sleeve elements 42 that are dimensioned to receive the intermediate portions of the plurality of support arm members 30 30' 30" such that the rain cover 10 forms a canopy over the bales of hay 200 contained within the hay enclosure framework 100 as depicted in FIGS. 1 and 2.

Figure 3:
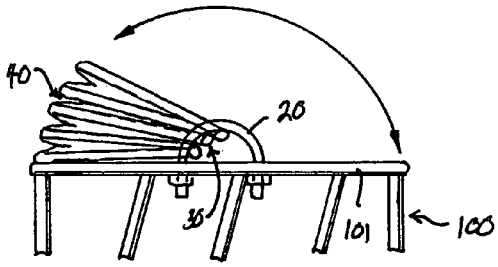
FIG. 3 is an isolated detailed end view of the rain cover in its collapsed position; and, FIG. 4 is an enlarged perspective view of one end of the rain cover and the associated portion of the hay framework.

Furthermore, as depicted in FIG. 3, when it is necessary to replenish the bales of hay 200 in the hay enclosure framework 100, the rain cover 10 can be retracted easily from either side of the enclosure framework 100 to substantially uncover the open top of the hay enclosure framework 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

The invention claimed is:

1. A rain cover for a hay enclosure framework having a horizontal top and bottom framework segments connected to one another by a plurality of generally vertical support struts wherein, the rain cover comprises:

a pair of U-bolt members connected on opposite ends of the horizontal top framework segments a support unit including a plurality of elongated generally C-shaped support arm members wherein, the opposite ends of each of the support arm members are slidably associated with said pair of U-bolt members; and, a cover unit including a waterproof elongated cover member having a plurality of spaced sleeve elements that captively engage the intermediate positions of said plurality of support arm members.

2. The rain cover as in claim 1; wherein, the opposite ends of at least one of the support arm members are provided with connector loops dimensioned to slidably engage said U-bolts.

3. The rain cover as in claim 1; wherein, the opposite ends of at least one of the support arm members are provided with a pair of hollow collar elements each provided with a connector loop that is dimensioned to slidably engage one of the U-bolts.

4. The rain cover as in claim 3; wherein, at least one of the support arm members has opposite ends that are threaded through said hollow collar elements and provided with a flanged end.

5. The rain cover as in claim 2; wherein, the opposite ends of at least one of the support arm members are provided with a pair of hollow collar elements each provided with a connector loop that is dimensioned to slidably engage one of the U-bolts.

6. The rain cover as in claim 5; wherein, at least one of the support arm members has opposite ends that are threaded through said hollow collar elements and provided with a flanged end.

* * * * *